US009110409B2

(12) United States Patent
Hayami

(10) Patent No.: US 9,110,409 B2
(45) Date of Patent: Aug. 18, 2015

(54) INTERMEDIATE TRANSFERRER, TRANSFER DEVICE, AND IMAGE FORMING APPARATUS

(71) Applicant: Konica Minolta, Inc., Tokyo (JP)

(72) Inventor: Toshiki Hayami, Tokyo (JP)

(73) Assignee: KONICA MINOLTA, INC. (JP)

( * ) Notice: Subject to any disclaimer, the term of this patent is extended or adjusted under 35 U.S.C. 154(b) by 0 days.

(21) Appl. No.: 14/062,110

(22) Filed: Oct. 24, 2013

(65) Prior Publication Data

US 2014/0119783 A1 May 1, 2014

(30) Foreign Application Priority Data

Oct. 25, 2012 (JP) ..... 2012-235612

(51) Int. Cl.
*G03G 15/16* (2006.01)

(52) U.S. Cl.
CPC ..... *G03G 15/162* (2013.01); *G03G 2215/0132* (2013.01)

(58) Field of Classification Search
USPC ..... 399/302
See application file for complete search history.

(56) References Cited

U.S. PATENT DOCUMENTS

| | | | | |
|---|---|---|---|---|
| 5,017,965 | A * | 5/1991 | Hashimoto et al. | 399/176 |
| 6,212,350 | B1 * | 4/2001 | Yamada et al. | 399/302 |
| 7,555,253 | B2 * | 6/2009 | Mizumoto | 399/286 |
| 2001/0026709 | A1 * | 10/2001 | Hara et al. | 399/174 |
| 2007/0122181 | A1 * | 5/2007 | Kamijo et al. | 399/101 |
| 2009/0028594 | A1 * | 1/2009 | Kojima | 399/66 |
| 2009/0297191 | A1 * | 12/2009 | Hirai et al. | 399/49 |
| 2012/0128953 | A1 * | 5/2012 | Kuraoka et al. | 428/215 |
| 2012/0155897 | A1 * | 6/2012 | Torimaru | 399/44 |
| 2012/0224873 | A1 * | 9/2012 | Aoki | 399/66 |
| 2012/0230740 | A1 * | 9/2012 | Mikami et al. | 399/308 |
| 2013/0108313 | A1 * | 5/2013 | Katagiri et al. | 399/101 |
| 2013/0216280 | A1 * | 8/2013 | Ichizawa | 399/313 |

FOREIGN PATENT DOCUMENTS

| | | | |
|---|---|---|---|
| JP | 2007292887 | A | 11/2007 |
| JP | 2009265343 | A | 11/2009 |

* cited by examiner

*Primary Examiner* — Clayton E Laballe
*Assistant Examiner* — Linda B Smith
(74) *Attorney, Agent, or Firm* — Cantor Colburn LLP

(57) ABSTRACT

A volume resistivity RA of an elastic layer of an intermediate transferrer is larger than a volume resistivity RB of a base layer of the intermediate transferrer under a HT/HH environment, and is smaller than RB under a LT/LH environment. A transfer device includes the intermediate transferrer. A volume resistivity RC of a transfer member of the transfer device is smaller than RA and RB under any temperature or humidity environment. An image forming apparatus includes the transfer device. The apparatus can suppress the occurrence of a transfer failure due to a change in temperature or humidity.

7 Claims, 3 Drawing Sheets

INTERMEDIATE TRANSFERRER, TRANSFER DEVICE, AND IMAGE FORMING APPARATUS

CROSS REFERENCE TO RELATED APPLICATIONS

This application is entitled to and claims the benefit of Japanese Patent Application No. 2012-235612, filed on Oct. 25, 2012, the disclosure of which including the specification, drawings and abstract is incorporated herein by reference in its entirety.

BACKGROUND OF THE INVENTION

1. Field of the Invention

The present invention relates to an intermediate transferrer to which a toner image formed in accordance with an electrostatic latent image on a photoconductor is to be transferred from the photoconductor as well as a transfer device and an image forming apparatus each including the intermediate transferrer.

2. Description of Related Art

In a general electrophotographic image forming apparatus, an electrostatic latent image is formed on a photoconductor, a toner image according to the electrostatic latent image is transferred to a recording medium such as normal paper, and the toner image is fixed onto the recording medium, whereby an image is formed on the recording medium. An apparatus including an intermediate transferrer is known as such an image forming apparatus as described above. In this image forming apparatus, a toner image is transferred from the photoconductor to the intermediate transferrer, and is then transferred from the intermediate transferrer to the recording medium.

Such transfer of the toner image from the photoconductor to the intermediate transferrer and then from the intermediate transferrer to the recording medium is performed by forming an appropriate electric field that promotes toner movement. From the perspective of securing the quality of a final image, electrical characteristics of the intermediate transferrer are important, and thus have been studied up to now.

For example, Japanese Patent Application Laid-Open No. 2009-265343 describes a multilayer elastic belt serving as an intermediate transferrer and including a substrate layer, an elastic layer formed thereon, and a surface layer formed on the elastic layer. Then, at 23° C. and 55% RH, the common logarithm value of the volume resistivity of a belt including the elastic layer and the surface layer is larger than that of a belt including the substrate layer.

For example, Japanese Patent Application Laid-Open No. 2007-292887 describes a transfer belt serving as an intermediate transferrer and including a base layer, an intermediate layer formed thereon, and a surface layer formed on the intermediate layer. Then, the surface resistivity of the base layer is larger than that of the intermediate layer.

The electrical characteristics of the intermediate transferrer change depending on environments surrounding the intermediate transferrer. For example, under a low-temperature low-humidity environment, as illustrated in FIG. 1A, electric charges are more likely to remain in intermediate transferrer 10. If electric charges injected from transfer roller 15 remain in intermediate transferrer 10, particularly, elastic layer 11, a discharge phenomenon may occur between intermediate transferrer 10 and photoconductor 20, on a more downstream side than a nip section (pre-nip section) formed by intermediate transferrer 10 and photoconductor 20 (for example, in a main nip section), a transfer failure may occur, and image noise may occur.

Meanwhile, under a high-temperature high-humidity environment, as illustrated in FIG. 1B, electric charges are likely to diffuse in intermediate transferrer 10. If the diffusion of the electric charges is promoted, an unnecessary electric field is generated in the pre-nip section, with the result that image disturbance may occur due to excessive current.

As described above, there is still a room for study to suppress a transfer failure due to the electrical characteristics of the intermediate transferrer at the time of an environmental fluctuation.

SUMMARY OF THE INVENTION

An object of the present invention is to provide an intermediate transferrer that can suppress the occurrence of a transfer failure due to a change in temperature or relative humidity.

Another object of the present invention is to provide a transfer device and an image forming apparatus each including the intermediate transferrer.

To achieve at least one of the above mentioned objects, an intermediate transferrer reflecting an aspect of the present invention includes: a base layer; and an elastic layer formed on the base layer. Then, RA is more than RB (RA>RB) under an environment of a first temperature T1 or a first relative humidity RH1, and RA is less than RB (RA<RB) under an environment of a second temperature T2 higher than T1 or a second relative humidity RH2 higher than RH1, where RA represents a volume resistivity of the elastic layer and RB represents a volume resistivity of the base layer.

A transfer device reflecting an aspect of the present invention includes: the intermediate transferrer according to the present invention; and a transfer member that applies a transfer voltage while being in contact with the base layer of the intermediate transferrer. Then, RA is more than RB, and RB is more than RC (RA>RB>RC) under the environment of T1 or RH1, and RB is more than RA, and RA is more than RC (RB>RA>RC) under the environment of T2 or RH2, where RC represents a volume resistivity of a portion of the transfer member in contact with the base layer.

An image forming apparatus reflecting an aspect of the present invention includes the transfer device according to the present invention, the transfer device transferring a toner image formed on a photoconductor to a recording medium.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein.

DESCRIPTION OF THE PREFERRED EMBODIMENTS

Hereinafter, embodiments of the present invention are described in detail with reference to the accompanying drawings.

[Intermediate Transferrer]

Figure 2:
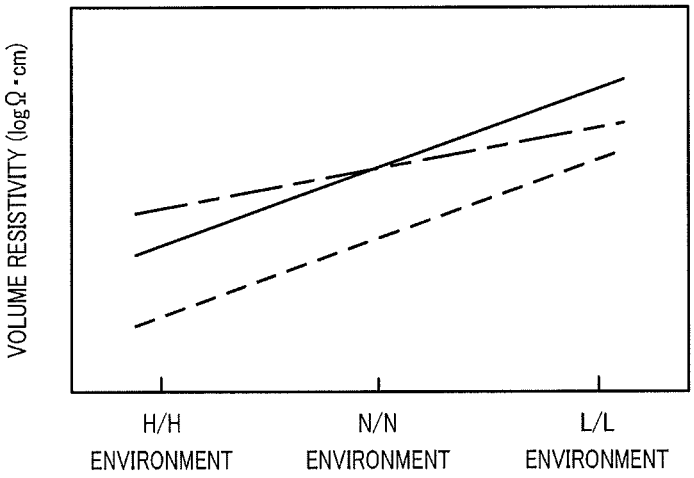
FIG. 2 is a logarithmic graph illustrating a relation of a volume resistivity to a temperature/relative humidity environment in portions that are in contact with the elastic layer and a base layer of the intermediate transferrer and a base layer of a transfer member.

An intermediate transferrer according to an embodiment of the present invention includes a base layer and an elastic layer formed thereon. In the present embodiment, as illustrated in FIG. 2, RA is more than RB (RA>RB) under an environment of a first temperature T1 or a first relative humidity RH1 (hereinafter, also referred to as "L/L environment"), and RA is less than RB (RA<RB) under an environment of a second temperature T2 higher than T1 or a second relative humidity RH2 higher than RH1 (hereinafter, also referred to as "H/H environment"), where RA represents a volume resistivity of the elastic layer and RB represents a volume resistivity of the base layer. In FIG. 2, a solid line represents RA, and an alternate long and short dash line represents RB. Note that, in FIG. 2, an "N/N environment" is an environment of a third temperature T3 or a third relative humidity RH3 (T1<T3<T2 and RH1<RH3<RH2).

T1 and T2 are set as appropriate so as to suit an environment under which the intermediate transferrer will be used, as long as a relation of T1<T2 is satisfied. Similarly, RH1 and RH2 are set as appropriate so as to suit an environment under which the intermediate transferrer will be used, as long as a relation of RH2>RH1 is satisfied. T1, T2, RH1, and RH2 may be, for example, the temperature or relative humidity of a space near the intermediate transferrer (for example, the internal space of the intermediate transferrer, a space near a nip section formed by the intermediate transferrer, and the like), and may be, for example, the temperature or relative humidity of an environment under which an image forming apparatus including the intermediate transferrer mounted thereon is installed.

When the temperature of an environment under which the intermediate transferrer according to the present embodiment will be used is divided into a low-temperature range, a normal-temperature range, and a high-temperature range, T1 can be defined as a representative value of the low-temperature range. T1 can be selected from, for example, a range of 5 to 17° C. T2 can be defined as a representative value of the high-temperature range. T2 can be selected from, for example, a range of 27 to 40° C. Examples of the representative value of each temperature range include a median value, a limit value (a lower limit or an upper limit), and the like of the temperature range. A difference between T1 and T2 is determined mainly by the installation environment and use conditions of the image forming apparatus, and is, for example, 20 to 25° C.

When the relative humidity of an environment under which the intermediate transferrer according to the present embodiment will be used is divided into a low-humidity range, a normal-humidity range, and a high-humidity range, RH1 can be defined as a representative value of the low-humidity range. RH1 can be selected from, for example, a range of 10 to 30%. RH2 can be defined as a representative value of the high-humidity range. RH2 can be selected from, for example, a range of 60 to 90%. Examples of the representative value of each humidity range include a median value, a limit value (a lower limit or an upper limit), and the like of the humidity range. A difference between RH1 and RH2 is determined mainly by the installation environment of the image forming apparatus, and is, for example, 50 to 70%.

The volume resistivity RA of the elastic layer and the volume resistivity RB of the base layer are not particularly limited and can be set as appropriate, as long as RA>RB under the L/L environment and RB>RA under the environment of T2 or RH2.

Under the L/L environment, a difference between RA' and RB' (RA'−RB') is preferably 0.1 to 2.0 and more preferably 0.5 to 1.5, from the perspective of suppressing the occurrence of an image failure during transfer and diffusing excessive electric charges in each layer. Under the H/H environment, a difference between RB' and RA' (RB'−RA') is preferably 0.1 to 2.0 and more preferably 0.2 to 1.2, from the perspective of easily satisfying a relation of RA>RB in a range of a numerical value larger than RC to be described later. Note that, RA' is the common logarithm value of RA and RB' is the common logarithm value of RB.

For example, considering that the above mentioned relation of RA and RB is satisfied and that a desired function of the intermediate transferrer is achieved, the volume resistivity RA of the elastic layer is preferably 11.0 to 12.5 Log Ω·cm ($10^{11}$ to $10^{12.5}$ Ω·cm) under the L/L environment, and is preferably 9.5 to 10.5 Log Ω·cm under the H/H environment. Under the N/N environment, the volume resistivity RA of the elastic layer is preferably 9.0 to 13.0 Log Ω·cm and more preferably 10.5 to 11.5 Log Ω·cm. Note that RA1<RA3<RA2 assuming that RA under the L/L environment is "RA1", that RA under the H/H environment is "RA2", and that RA under the N/N environment is "RA3".

For example, considering that the above mentioned relation of RA and RB is satisfied and that a desired function of the intermediate transferrer is achieved, the volume resistivity RB of the base layer is preferably 11.0 to 12.0 Log Ω·cm under the L/L environment, and is preferably 10.0 to 11.0 Log Ω·cm under the H/H environment. Under the N/N environment, the volume resistivity RB of the base layer is preferably 9.0 to 13.0 Log Ω·cm and more preferably 10.5 to 11.5 Log Ω·cm. Note that RB1<RB3<RB2 assuming that RB under the L/L environment is "RB1", that RB under the H/H environment is "RB2", and that RB under the N/N environment is "RB3".

Further, considering that the above mentioned relation of RA and RB is satisfied and that a desired function of the intermediate transferrer is achieved, RT is preferably 11.2 to 12.2 Log Ω·cm under the L/L environment, and is preferably 9.7 to 10.7 Log Ω·cm under the H/H environment. Note that, RT is the volume resistivity of a laminated product of the base layer and the elastic layer (for example, the intermediate transferrer).

The volume resistivity RA of the elastic layer and the volume resistivity RB of the base layer are obtained by, for example, removing one of the layers from the intermediate transferrer, thus preparing a sample for measurement, and measuring the volume resistance value of the sample for measurement. Further, the volume resistivity RT of the laminated product is obtained by, for example, measuring the volume resistance value of the intermediate transferrer as it is. The volume resistivities of the elastic layer, the base layer, and the laminated product can be measured using, for example, a resistivity meter (Hiresta produced by Mitsubishi Chemical Corporation).

The base layer can be a resin layer in which a conduction agent is dispersed. Examples of resins used for the material of the base layer include polyimide and fluorine resins such as ethylene-tetrafluoroethylene copolymer (ETFE) and polyvinylidene fluoride (PVDF).

Examples of the conduction agent include an ion conduction agent and an electron conduction agent. Examples of the ion conduction agent include silver iodide, copper iodide, lithium perchlorate, lithium trifluoromethanesulfonate, lithium salts of organoboron complexes, lithium bisimide ($(CF_3SO_2)_2NLi$), and lithium trismethide ($(CF_3SO_2)_3CLi$).

Examples of the electron conduction agent include: metals such as silver, copper, aluminum, magnesium, nickel, and stainless steel; and carbon compounds such as graphite, carbon black, carbon nanofibers, and carbon nanotubes.

From the perspective of further enhancing an effect of suppressing an image failure during transfer by means of the above mentioned relation of RA and RB, it is preferable to make larger a difference between RA under the L/L environment and RA under the H/H environment and make smaller a difference between RB under the L/L environment and RB under the H/H environment. From such a perspective as described above, it is preferable that the elastic layer has an ion conduction property and that the base layer has an electron conduction property. The elastic layer having an ion conduction property can be obtained by using the ion conduction agent as the conduction agent for the elastic layer. The base layer having an electron conduction property can be obtained by using the electron conduction agent as the conduction agent for the base layer.

The elastic layer can also be a resin layer in which a conduction agent is dispersed. Examples of resins used for the material of the elastic layer include urethane rubber, chloroprene rubber (CR), and nitrile rubber (NBR). The conduction agent can be selected from among the conduction agents listed above.

The thickness of the base layer is not particularly limited as long as effects of the present embodiment can be obtained. The thickness of the base layer is preferably 50 to 200 μm and more preferably 80 to 120 μm, from the perspective of, for example, strength and conduction properties.

Similarly, the thickness of the elastic layer is not particularly limited as long as effects of the present embodiment can be obtained. The thickness of the elastic layer is preferably 100 to 500 μm and more preferably 120 to 300 μm, from the perspective of, for example, the adhesiveness to a photoconductor and conduction properties.

The intermediate transferrer according to the present embodiment may further include other components than the base layer and the elastic layer. Further, the intermediate transferrer according to the present embodiment normally has an endless form like a belt or a drum, but may have a sheet or flat-plate form. Examples of the other components include a substrate that supports the base layer, a surface layer formed on the elastic layer, and the like. Examples of the substrate include a conductive support such as a sleeve made of aluminum. Examples of the surface layer include layers made of fluorine resins and resins having excellent demolding properties, such as silicone. The other components can be selected from various components that are normally used as components of the intermediate transferrer.

Charging characteristics of the intermediate transferrer according to the present embodiment change so that the occurrence of an image failure during transfer is suppressed, in accordance with a change in temperature or humidity.

Under the L/L environment, electric charges are likely to remain in both the elastic layer and the base layer, and the electric charges remaining in the elastic layer, which cause more image failures due to discharging, are more problematic. Under the L/L environment, because RB is smaller than RA, the electric charges excessively remaining in the elastic layer are likely to diffuse in the base layer.

Under the H/H environment, electric charges are more likely to diffuse in both the elastic layer and the base layer, compared with the L/L environment. Accordingly, RA and RB under the H/H environment are smaller enough to suppress such discharging as described above, compared with RA and RB under the L/L environment. Hence, under the H/H environment, the electric charges remaining in the base layer, which cause further diffusion of the electric charges in the elastic layer due to electric charge diffusion, are more problematic. Under the H/H environment, because RB is larger than RA, excessive diffusion of the electric charges in the base layer is suppressed, with the result that diffusion of the electric charges in the elastic layer is suppressed.

Accordingly, when the intermediate transferrer according to the present embodiment is mounted on the image forming apparatus, the intermediate transferrer according to the present embodiment can suppress, under the L/L environment, the occurrence of an image failure such as discharging noise, and can suppress, under the H/H environment, the occurrence of an image failure such as image disturbance due to excessive current. In this way, according to the present embodiment, even if a temperature or humidity environment changes, excessive concentration of electric charges and excessive diffusion of electric charges in the intermediate transferrer are suppressed.

Under the L/L environment, if RA is 0.5 to 1.5 orders of magnitude larger than RB (i.e. a difference obtained by subtracting the common logarithm value RB' of RB from the common logarithm value RA' of RA is 0.5 to 1.5), this is still more effective from the perspective of diffusing excessive electric charges in each layer, in addition to the above mentioned effect.

In general, an ion conduction property brings about a larger change in volume resistivity than an electron conduction property, upon a change in temperature or humidity environment. Accordingly, if the elastic layer has an ion conduction property and the base layer has an electron conduction property, this is still more effective from the perspective of further enhancing the effect of suppressing the occurrence of an image failure described above.

[Transfer Device]

A transfer device according to the present embodiment includes: the above mentioned intermediate transferrer according to the present embodiment; and a transfer member that applies a transfer voltage while being in contact with the base layer of the intermediate transferrer. The form of the transfer member can be selected from known forms like a roller, a belt, a blade, and the like.

In the present embodiment, the transfer member has a predetermined volume resistivity. That is, assuming that the volume resistivity of a portion (hereinafter, also referred to as "contact portion") of the transfer member in contact with the base layer is RC, as illustrated in FIG. 2, RA>RB>RC under the L/L environment, and RB>RA>RC under the H/H environment. In FIG. 2, a broken line represents RC.

If RC is 2.0 to 5.0 orders of magnitude smaller than RA, this is preferable from the perspective of satisfying the above mentioned relation of RA, RB, and RC. If RC is 3.5 to 4.5 orders of magnitude smaller than RA, that is, if the following expression is satisfied, this is more preferable from the perspective of achieving at the same time both voltage application from the transfer member to the intermediate transferrer and collection of excessive electric charges remaining in the intermediate transferrer:

$3.5 \leq RA' - RC' \leq 4.5$.

If RC has an environmental dependency similar to that of RA, this is preferable from the perspective of easily satisfying the above mentioned relation of RA, RB, and RC. "RC has an environmental dependency similar to that of RA" refers to that, as illustrated in FIG. 2, the slopes of RA and RC in a logarithmic graph are substantially the same when a temperature or humidity environment is changed. More specifically, assuming that the common logarithm value of RC is RC', an increment of RC' when the temperature changes from T1 to T2 or the relative humidity changes from RH1 to RH2 is defined as "rc", and an increment of RA' when the temperature changes from T1 to T2 or the relative humidity changes from RH1 to RH2 is defined as "ra." At this time, the ratio of ra to rc (ra/rc) is 0.8 to 1.2.

In the case where the slope of RA and the slope of RC in the logarithmic graph are substantially the same, and if the relation of RA>RB>RC under the L/L environment is satisfied, desired relations of RA, RB, and RC under other environments can be achieved on their own. Accordingly, ra/rc is preferably 0.8 to 1.2 and more preferably 0.85 to 1.15. Such a relation of ra/rc as described above can be achieved by, for example, making the contact portion using the same material, particularly, the same conduction agent as that of the elastic layer of the intermediate transferrer.

In the case where the transfer member is a roller or a belt, the contact portion corresponds to a layer formed on the surface of the roller or the belt. In the case where the transfer member is a blade, the contact portion corresponds to at least a leading end edge of the blade. Such a contact portion is normally formed of an elastic body in which a conduction agent is dispersed. Examples of the material of the elastic body include resins having elasticity, such as urethane and nitrile rubber. Examples of the conduction agent include the ion conduction agents and the electron conduction agents described above. The elastic body can be in a solid form, a foam form, and the like of these resins, but is not limited to these forms. The transfer member including the contact portion can be made according to a known method.

The transfer device according to the present embodiment may further include other components than the intermediate transferrer and the transfer member according to the present embodiment. Examples of the other components include: a plurality of rollers including a driving roller, for providing thereon an endless belt type intermediate transferrer in a tensioned state; a cleaning device that removes toner remaining on the surface of the intermediate transferrer; and a secondary transfer member that is pressed against the intermediate transferrer with a recording medium located therebetween and applies a secondary transfer voltage to the recording medium.

The volume resistivity RC of the transfer device according to the present embodiment is smaller than RA and RB under both the L/L environment and the H/H environment. Hence, excessive electric charges remaining in the intermediate transferrer can be promptly collected to the transfer member.

If a difference obtained by subtracting RC' from RA' is 3.5 to 4.5, this is still more effective from the perspective of promptly collecting excessive electric charges remaining in the intermediate transferrer to the transfer member and smoothly applying a transfer voltage from the transfer member to the intermediate transferrer, in addition to the above mentioned effect.

Moreover, if the increment rc (change rate) of the common logarithm value of RC is substantially the same as the increment ra of the common logarithm value of RA (i.e. ra/rc is 0.8 to 1.2) between the L/L environment and the H/H environment, this is preferable from the perspective of easily and reliably achieving the above mentioned relation of RA, RB, and RC, in addition to the above mentioned effect.

[Image Forming Apparatus]

An image forming apparatus according to the present embodiment can be configured similarly to a known image forming apparatus including an intermediate transferrer, except that the image forming apparatus according to the present embodiment includes a transfer device according to the present embodiment to be described later. The image forming apparatus according to the present embodiment includes, for example: a photoconductor; a charging device that charges the photoconductor; an exposing device that irradiates the charged photoconductor with light and forms an electrostatic latent image; a developing device that supplies toner to the photoconductor having the electrostatic latent image formed thereon, and forms a toner image in accordance with the electrostatic latent image; the transfer device that transfers the toner image formed in accordance with the electrostatic latent image, to a recording medium; and a fixing device that fixes the toner image onto the recording medium. The "toner image" refers to a state where the toner gathers together in the form of an image.

Figure 3:
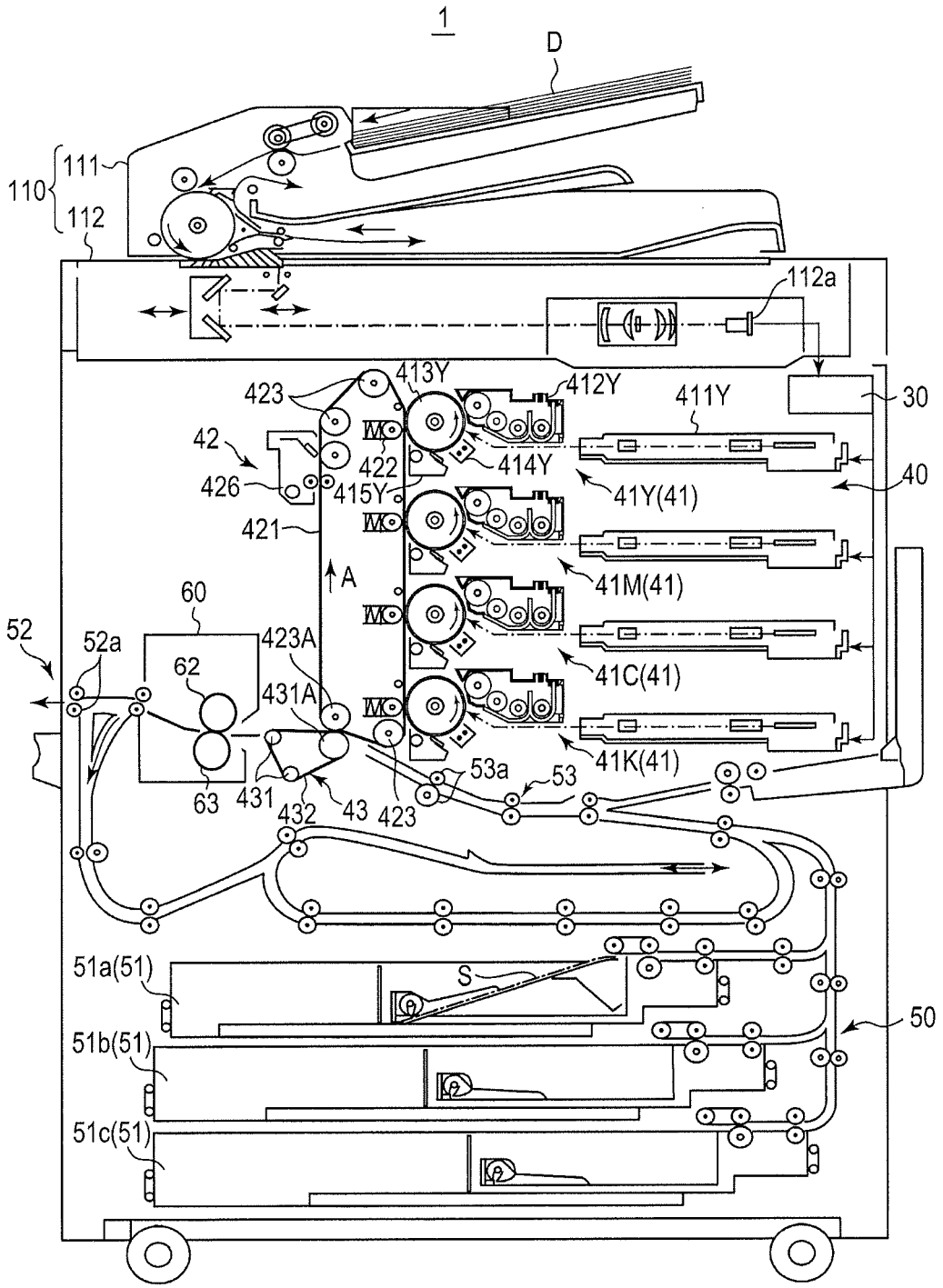
FIG. 3 schematically illustrates a configuration of an image forming apparatus according to an embodiment of the present invention.

FIG. 3 schematically illustrates a configuration of an image forming apparatus according to an embodiment of the present invention. As illustrated in FIG. 3, image forming apparatus 1 includes image reading section 110, image processing section 30, image forming section 40, sheet conveying section 50, and fixing device 60.

Image forming section 40 includes image forming units 41Y, 41M, 41C, and 41K that respectively form images using toners of four colors of yellow (Y), magenta (M), cyan (C), and black (K). Image forming units 41Y, 41M, 41C, and 41K have the same configuration except for the toner housed therein, and hence the symbol representing each color may be omitted hereinafter. Image forming section 40 further includes intermediate transfer unit 42 and secondary transfer unit 43. Intermediate transfer unit 42 and secondary transfer unit 43 correspond to the transfer device.

Image forming unit 41 includes exposing device 411, developing device 412, photoconductor drum 413, charging device 414, and drum cleaning device 415. Photoconductor drum 413 is, for example, a negative charge type organic photoconductor. The surface of photoconductor drum 413 has a photoconduction property. Photoconductor drum 413 corresponds to the photoconductor. Charging device 414 is, for example, a corona charger. Charging device 414 may be a contact charging device that brings a contact charging member such as a charging roller, a charging brush, and a charging blade into contact with photoconductor drum 413 to thereby charge photoconductor drum 413. Exposing device 411 comprises, for example, a semiconductor laser. Developing device 412 is, for example, a developing device adopting a two-component developing method.

Intermediate transfer unit 42 includes intermediate transfer belt 421, primary transfer rollers 422 that each press intermediate transfer belt 421 against corresponding photoconductor drum 413, a plurality of support rollers 423 including backup roller 423A, and belt cleaning device 426. Intermediate transfer belt 421 is an endless belt. Intermediate transfer belt 421 is provided on the plurality of support rollers 423 in a loop-like tensioned state. At least one driving roller of the plurality of support rollers 423 rotates, whereby intermediate transfer belt 421 runs at a constant speed in an arrow A direction.

Intermediate transfer belt 421 corresponds to the intermediate transferrer. Primary transfer rollers 422 each correspond to the transfer member.

Figure 1A:
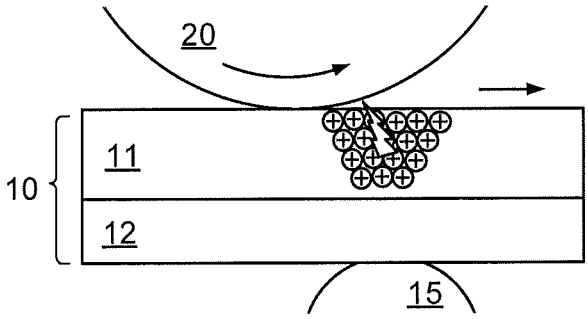
FIG. 1A schematically illustrates a behavior of electric charges in an elastic layer of an intermediate transferrer under a low-temperature low-humidity environment, and FIG. 1B schematically illustrates a behavior of electric charges in the elastic layer of the intermediate transferrer under a high-temperature high-humidity environment.
Figure 1B:
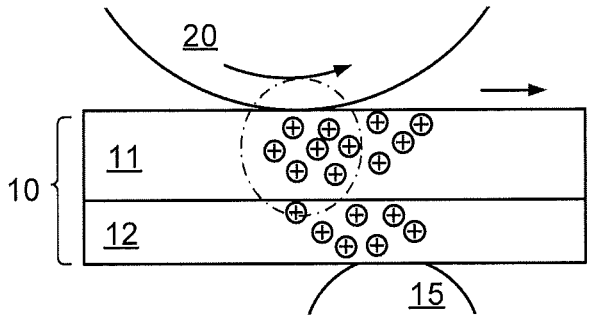

Note that each primary transfer roller 422 is arranged on a slightly more downstream side than corresponding photoconductor drum 413 in the running direction of intermediate transfer belt 421, similarly to the positional relation of photoconductor 20, intermediate transferrer 10, and transfer roller 15 illustrated in FIGS. 1A and 1B. In this arrangement, a nip section (also referred to as "pre-nip section") formed by intermediate transfer belt 421 and photoconductor drum 413 is located on a slightly more upstream side than a nip section (also referred to as "post-nip section") formed by intermediate transfer belt 421 and primary transfer roller 422. A portion between the pre-nip section and the post-nip section is also referred to as "main nip section".

Secondary transfer unit 43 includes endless secondary transfer belt 432 and a plurality of support rollers 431 including secondary transfer roller 431A. Secondary transfer belt 432 is provided on secondary transfer roller 431A and support rollers 431 in a loop-like tensioned state.

Fixing device 60 includes: fixing roller 62 that heats and fuses toner forming a toner image on sheet S; and pressure roller 63 that presses sheet S against fixing roller 62. Sheet S corresponds to the recording medium.

Image forming apparatus 1 further includes image reading section 110, image processing section 30, and sheet conveying section 50. Image reading section 110 includes automatic sheet feeder 111 and original image scanner 112. Sheet conveying section 50 includes sheet feeding section 51, sheet discharging section 52, and conveyance path section 53.

Three sheet feed tray units 51*a* to 51*c* forming sheet feeding section 51 house therein, for each preset type, sheets S (standard sheets, special sheets) that are discriminated on the basis of the basis weight, the size, and the like. Conveyance path section 53 includes a plurality of paired conveyance rollers such as paired registration rollers 53*a*.

Formation of an image by image forming apparatus 1 is described.

Original image scanner 112 optically scans and reads original D on its contact glass. Light reflected from original D is read by CCD sensor 112*a* to thereby provide input image data. The input image data is subjected to predetermined image processing by image processing section 30, and is then sent to exposing device 411.

Photoconductor drum 413 rotates at a constant circumferential speed. Charging device 414 uniformly negatively charges the surface of photoconductor drum 413. Exposing device 411 irradiates photoconductor drum 413 with laser light corresponding to the input image data of each color component. As a result, an electrostatic latent image is formed on the surface of photoconductor drum 413. Developing device 412 attaches toner onto the surface of photoconductor drum 413, whereby the electrostatic latent image is visualized. As a result, a toner image according to the electrostatic latent image is formed on the surface of photoconductor drum 413.

The toner image on the surface of photoconductor drum 413 is transferred to intermediate transfer belt 421 by intermediate transfer unit 42. The residual toner that remains on the surface of photoconductor drum 413 after the transfer is removed by drum cleaning device 415 including a drum cleaning blade in sliding contact with the surface of photoconductor drum 413.

Intermediate transfer belt 421 is pressed against photoconductor drum 413 by primary transfer roller 422, whereby toner images of respective colors are sequentially transferred to intermediate transfer belt 421 so as to be superimposed on top of each other. The residual toner that remains on the surface of intermediate transfer belt 421 after the transfer is removed by belt cleaning device 426 including a belt cleaning blade in sliding contact with the surface of intermediate transfer belt 421.

Secondary transfer roller 431A is pressed against backup roller 423A with intermediate transfer belt 421 and secondary transfer belt 432 located therebetween, whereby a transfer nip is formed. Sheet S passes through the transfer nip. Sheet S is conveyed to the transfer nip by sheet conveying section 50. Inclination correction and conveyance timing adjustment of sheet S are performed by a registration roller section including paired registration rollers 53*a* placed therein.

When sheet S is conveyed to the transfer nip, a transfer bias is applied to secondary transfer roller 431A. Through the application of the transfer bias, the toner image carried on intermediate transfer belt 421 is transferred to sheet S. Sheet S to which the toner image has been transferred is conveyed to fixing device 60 by secondary transfer belt 432.

Fixing device 60 heats and pressurizes sheet S conveyed thereto in its nip section. As a result, the toner image is fixed onto sheet S. Sheet S onto which the toner image has been fixed is discharged to the outside of the image forming apparatus by sheet discharging section 52 including sheet discharging roller 52*a*.

The image forming apparatus according to the present embodiment includes the transfer device according to the present embodiment, and thus can suppress the occurrence of an image failure due to electric charges remaining or diffusing in the intermediate transferrer. Hence, an image failure due to a change in temperature or relative humidity during transfer can be suppressed. Accordingly, an image having a desired quality can be stably formed regardless of a change in temperature or relative humidity. Further, the intermediate transferrer and the photoconductor are in contact with each other on a more upstream side in the running direction of the intermediate transferrer, and the intermediate transferrer and the transfer member are in contact with each other on a more downstream side in the running direction thereof. This is still more effective from the perspective of promptly and smoothly collecting excessive electric charges remaining in the intermediate transferrer to the transfer member located on the more downstream side, in addition to the above mentioned effect.

EXAMPLES

Example 1

Endless belt type base layer A containing polyimide in which carbon black is dispersed as the electron conduction agent is prepared. Carbon black is dispersed as the electron conduction agent in polyamide acid varnish. The obtained varnish is applied to the inner surface of a cylindrical mold. The obtained coating film is dried and cured. As a result, an endless belt of base layer A having a thickness of 80 μm is made.

An elastic layer is formed on the outer peripheral surface of the belt of base layer A. A urethane rubber material in which carbon black is dispersed as the electron conduction agent is applied to the outer peripheral surface of the belt of base layer A, using, for example, an applying apparatus that is normally used for application of a rubber material to a belt surface. The coating film of the urethane rubber material formed through this application is dried and cured using known means such as a heater. As a result, elastic layer A-1 having a thickness of 200 μm is made on the outer peripheral surface of the belt of base layer A, so that intermediate transfer belt A including base layer A and elastic layer A-1 is obtained.

Meanwhile, the volume resistivities of the belt of base layer A and elastic layer A-1 are measured. The volume resistivity of elastic layer A-1 is measured with a belt of elastic layer A-1 being used as an analyte. The belt of elastic layer A-1 is obtained by, for example, forming a similar belt to that of base layer A using the urethane rubber material instead of the material of base layer A. The volume resistivities of the belt of base layer A and the belt of elastic layer A-1 are each obtained by: setting four measurement points in the circumferential direction in each of three portions in the axial direction of each belt, that is, setting twelve measurement points in total; measuring the volume resistivity at each measurement point using "Hiresta" produced by Mitsubishi Chemical Corporation; and calculating an average value of the measured volume resistivities. That is, the volume resistivities of the belt of base layer A and the belt of elastic layer A-1 are each obtained as the average value thus calculated.

The volume resistivity of the belt of base layer A is 11.2 Log Ω·cm under the low-temperature low-humidity environment (10° C., 20 RH %), and is 10.4 Log Ω·cm under the high-temperature high-humidity environment (30° C., 80 RH %). The volume resistivity of the belt of elastic layer A-1 is 11.8 Log Ω·cm under the low-temperature low-humidity environment (10° C., 20 RH %), and is 10.2 Log Ω·cm under the high-temperature high-humidity environment (30° C., 80 RH %).

Next, transfer roller A is prepared. For transfer roller A, conductive elastic layer A-2 is formed on a cored bar. A urethane rubber material in which carbon black is dispersed as the electron conduction agent is applied to the outer peripheral surface of the cored bar, using, for example, an applying apparatus that is normally used for application of a rubber material to a cored bar surface, whereby elastic layer A-2 is formed on the cored bar. As a result, transfer roller A including elastic layer A-2 is obtained.

The volume resistivity of elastic layer A-2 of obtained transfer roller A is 8.2 Log Ω·cm under the low-temperature low-humidity environment (10° C., 20 RH %), and is 6.8 Log Ω·cm under the high-temperature high-humidity environment (30° C., 80 RH %). The volume resistivity of elastic layer A-2 is an average value of measurement values respectively obtained at twelve measurement points, similarly to the volume resistivities of the belt of base layer A and the belt of elastic layer A-1.

On the image forming apparatus illustrated in FIG. 3, intermediate transfer belt A is mounted as intermediate transfer belt 421, and transfer roller A is mounted as each primary transfer roller 422. Then, if an image is formed using the image forming apparatus thus configured under each of the low-temperature low-humidity environment (10° C., 20 RH %) and the high-temperature high-humidity environment (30° C., 80 RH %), an excellent image without image noise during transfer, such as discharging noise and image deletion, can be obtained. This is considered to be because: (1) the volume resistivity (RB) of base layer A of intermediate transfer belt A, the volume resistivity (RA) of elastic layer A-1 of intermediate transfer belt A, and the volume resistivity (RC) of elastic layer A-2 of transfer roller A satisfy such a magnitude relation as illustrated in FIG. 2; (2) hence, excessive concentration of electric charges in elastic layer A-1 under the low-temperature low-humidity environment can be suppressed, and excessive diffusion of electric charges in elastic layer A-1 and base layer A under the high-temperature high-humidity environment can be suppressed; and (3) electric charges excessively remaining in intermediate transfer belt A are smoothly collected to elastic layer A-2.

Example 2

Carbon black is dispersed as the electron conduction agent in polyamide acid varnish. The obtained varnish is applied to the inner surface of a cylindrical mold. The obtained coating film is dried and cured. As a result, an endless belt of base layer B having a thickness of 80 μm is made.

Then, elastic layer B-1 is formed on the outer peripheral surface of the belt of base layer B. Nitrile rubber (NBR) in which the ion conduction agent is dispersed is applied to the outer peripheral surface of the belt of base layer B, using, for example, an applying apparatus, similarly to Example 1. As a result, elastic layer B-1 having a thickness of 200 μm is made on the outer peripheral surface of the belt of base layer B, whereby intermediate transfer belt B including base layer B and elastic layer B-1 is obtained.

Next, transfer roller B is prepared. The same nitrile rubber in which the ion conduction agent is dispersed, as that used for elastic layer B-1, is applied to the outer peripheral surface of a cored bar, using, for example, an applying apparatus, similarly to Example 1, whereby elastic layer B-2 is formed on the cored bar. As a result, transfer roller B including elastic layer B-2 having the ion conduction property is obtained.

The volume resistivities of base layer B, elastic layer B-1, and elastic layer B-2 are measured in a similar manner to that in Example 1. The volume resistivity of the belt of base layer B is 11.4 Log Ω·cm under the low-temperature low-humidity environment (10° C., 20 RH %), and is 10.5 Log Ω·cm under the high-temperature high-humidity environment (30° C., 80 RH %). The volume resistivity of a belt of elastic layer B-1 is 12.5 Log Ω·cm under the low-temperature low-humidity environment (10° C., 20 RH %), and is 10.2 Log Ω·cm under the high-temperature high-humidity environment (30° C., 80 RH %). The volume resistivity of elastic layer B-2 is 8.4 Log Ω·cm under the low-temperature low-humidity environment (10° C., 20 RH %), and is 6.4 Log Ω·cm under the high-temperature high-humidity environment (30° C., 80 RH %).

Similarly to Example 1, intermediate transfer belt B and transfer roller B are mounted on the image forming apparatus. Then, if an image is formed under each of the low-temperature low-humidity environment (10° C., 20 RH %) and the high-temperature high-humidity environment (30° C., 80 RH %), an excellent image without image noise during transfer, such as discharging noise and image deletion, can be obtained. In the present example, the change rates of the volume resistivities of elastic layer B-1 and elastic layer B-2 are substantially the same (ra/rc=1.15), and are larger than twice or more the change rate of the volume resistivity of base layer B. Accordingly, Example 2 is effective from the perspective of further enhancing the effects produced in Example 1.

As described above, in the present example, the change rates of the volume resistivities of elastic layer B-1 and elastic layer B-2 are substantially the same (ra/rc=1.15). Accordingly, if intermediate transfer belt B and transfer roller B are designed such that a relation of the volume resistivities of base layer B (RB), elastic layer B-1 (RA), and elastic layer B-2 (RC) under the low-temperature low-humidity environment satisfies the relation of RA>RB>RC, a desired relation of RA, RB, and RC can be achieved on its own. If the slopes of RA and RC are made coincident with each other as described above, this is preferable from the perspective of easily and reliably achieving the relation of RA, RB, and RC, in addition to the effects provided in Example 1. In particular, if the slopes of RA and RC are made coincident with each other, the relation of RB>>RC can be established without fail under the high-temperature high-humidity environment. Under the high-temperature high-humidity environment, base layer B has the highest resistance, and hence it is feared that electric charges may remain in a pre-nip section and a portion (a main nip section or a post-nip section) located on a more downstream side than the pre-nip section, of base layer B. Fortunately, elastic layer B-2 having a resistance sufficiently lower than that of base layer B is in contact with base layer B, and hence the electric charges in base layer B can be more promptly absorbed into the transfer member.

INDUSTRIAL APPLICABILITY

The intermediate transferrer according to the present embodiment can suppress an image failure during transfer regardless of a change in temperature or humidity environment. Accordingly, the image forming apparatus that forms a high quality image regardless of a change in environment can be expected to be widely spread and developed.

What is claimed is:

1. An intermediate transfer belt comprising:

a base layer; and an elastic layer formed on the base layer, wherein the thickness of the base layer is 50 to 200 μm;

the thickness of the elastic layer is 100 to 500 μm; and

RA is more than RB (RA>RB) under an environment of a first temperature T1 or a first relative humidity RH1, and RA is less than RB (RA<RB) under an environment of a second temperature T2 higher than T1 or a second relative humidity RH2 higher than RH1, where RA represents a volume resistivity of the elastic layer and RB represents a volume resistivity of the base layer.

2. The intermediate transfer belt according to claim 1, wherein the following expression is satisfied under the environment of T1 or RH1:

$$0.5 \leq RA' - RB' \leq 1.5$$

where RN represents a common logarithm value of RA, and RB' represents a common logarithm value of RB.

3. The intermediate transfer belt according to claim 1, wherein the elastic layer has an ion conduction property, and the base layer has an electron conduction property.

4. A transfer device comprising:

an intermediate transfer belt comprising:

a base layer; and an elastic layer formed on the base layer, wherein the thickness of the base layer is 50 to 200 μm;

the thickness of the elastic layer is 100 to 500 μm; and

RA is more than RB (RA>RB) under an environment of a first temperature T1 or a first relative humidity RH1, and RA is less than RB (RA<RB) under an environment of a second temperature T2 higher than T1 or a second relative humidity RH2 higher than RH1, where RA represents a volume resistivity of the elastic layer and RB represents a volume resistivity of the base layer; and a transfer member that applies a transfer voltage while being in contact with the base layer of the intermediate transferrer, wherein RA is more than RB, and RB is more than RC (RA>RB>RC) under the environment of T1 or RH1, and RB is more than RA, and RA is more than RC (RB>RA>RC) under the environment of T2 or RH2, where RC represents a volume resistivity of a portion of the transfer member in contact with the base layer.

5. The transfer device according to claim 4, wherein the following expression is satisfied:

$$3.5 \leq RA' - RC' \leq 4.5,$$

where RC' represents a common logarithm value of RC.

6. The transfer device according to claim 5, wherein the following expression is satisfied:

$$0.8 \leq ra/rc \leq 1.2,$$

where "rc" represents an increment of RC' when temperature changes from T1 to T2 or relative humidity changes from RH1 to RH2, and "ra" represents an increment of RN when temperature changes from T1 to T2 or relative humidity changes from RH1 to RH2.

7. An image forming apparatus comprising;

a transfer device that transfers a toner image formed on a photoconductor to a recording medium, wherein the transfer device comprises:

an intermediate transfer belt comprising:

a base layer; and an elastic layer formed on the base layer, wherein the thickness of the base layer is 50 to 200 μm;

the thickness of the elastic layer is 100 to 500 μm; and

RA is more than RB (RA>RB) under an environment of a first temperature T1 or a first relative humidity RH1, and RA is less than RB (RA<RB) under an environment of a second temperature T2 higher than T1 or a second relative humidity RH2 higher than RH1, where RA represents a volume resistivity of the elastic layer and RB represents a volume resistivity of the base layer; and a transfer member that applies a transfer voltage while being in contact with the base layer of the intermediate transferrer, wherein RA is more than RB, and RB is more than RC (RA>RB>RC) under the environment of T1 or RH1, and RB is more than RA, and RA is more than RC (RB>RA>RC) under the environment of T2 or RH2, where RC represents a volume resistivity of a portion of the transfer member in contact with the base layer.

* * * * *